US008561359B2

(12) United States Patent
Rosten et al.

(10) Patent No.: US 8,561,359 B2
(45) Date of Patent: Oct. 22, 2013

(54) BAFFLE VENT WITH INTEGRAL DRIFT BLOCKER

(75) Inventors: David B. Rosten, Isanti, MN (US); David J. Bonanni, Fleetwood, PA (US); Richard Pirino, Wyomissing, PA (US)

(73) Assignee: Brentwood Industries, Inc., Reading, PA (US)

( * ) Notice: Subject to any disclaimer, the term of this patent is extended or adjusted under 35 U.S.C. 154(b) by 982 days.

(21) Appl. No.: 12/199,622

(22) Filed: Aug. 27, 2008

(65) Prior Publication Data

US 2009/0056236 A1 Mar. 5, 2009

Related U.S. Application Data

(60) Provisional application No. 60/969,859, filed on Sep. 4, 2007.

(51) Int. Cl.
*E04B 7/00* (2006.01)

(52) U.S. Cl.
USPC ..... 52/95; 52/94; 52/199; 52/302.1; 52/630

(58) Field of Classification Search
USPC ..... 52/94, 95, 199, 302.1, 198, 630, 96; 428/128, 130; 454/260, 250
See application file for complete search history.

(56) References Cited

U.S. PATENT DOCUMENTS

| | | | | |
|---|---|---|---|---|
| 4,096,790 | A | 6/1978 | Curran | 98/37 |
| 4,406,095 | A * | 9/1983 | Slavik | 52/95 |
| 4,446,661 | A | 5/1984 | Jonsson | 52/95 |
| 4,660,463 | A * | 4/1987 | Bottomore et al. | 454/260 |
| 4,977,714 | A * | 12/1990 | Gregory, Jr. | 52/95 |
| 5,238,450 | A * | 8/1993 | Rotter | 454/260 |
| 5,341,612 | A | 8/1994 | Robbins | 52/95 |
| 5,596,847 | A | 1/1997 | Stephenson | 52/198 |
| 5,740,636 | A * | 4/1998 | Archard | 52/94 |
| 5,918,425 | A * | 7/1999 | Archard et al. | 52/95 |
| 6,346,040 | B1 * | 2/2002 | Best | 454/260 |
| 6,347,991 | B1 * | 2/2002 | Bogrett et al. | 454/260 |
| 7,094,145 | B2 | 8/2006 | Rye | 454/366 |
| 8,381,458 | B2 * | 2/2013 | Rider et al. | 52/95 |
| 2007/0151176 | A1 | 7/2007 | Mumaw | 52/198 |

* cited by examiner

*Primary Examiner* — William Gilbert
*Assistant Examiner* — Alp Akbasli
(74) *Attorney, Agent, or Firm* — Miller Law Group, PLLC

(57) ABSTRACT

A baffle vent incorporates an integral drift blocker portion that is connected to the main body portion of the baffle vent by a generally planar transition portion to allow the drift blocker portion to move relative to the main body portion. The main body portion is formed with transversely extending stiffening ribs, while the drift blocker portion is formed with longitudinally extending stiffening ribs with the transition portion being devoid of stiffening ribs to maintain flexibility in the transition portion. The baffle vent structure can be formed in large sheets that span several roof rafters with multiple integral drift blocker portions formed to be positioned between the roof rafters. A deck baffle panel is also provided in a configuration similar to the main body portion to be installed beneath attic flooring in manufactured housing to allow an air flow to remove moisture from beneath the attic flooring.

16 Claims, 13 Drawing Sheets

Fig. 1
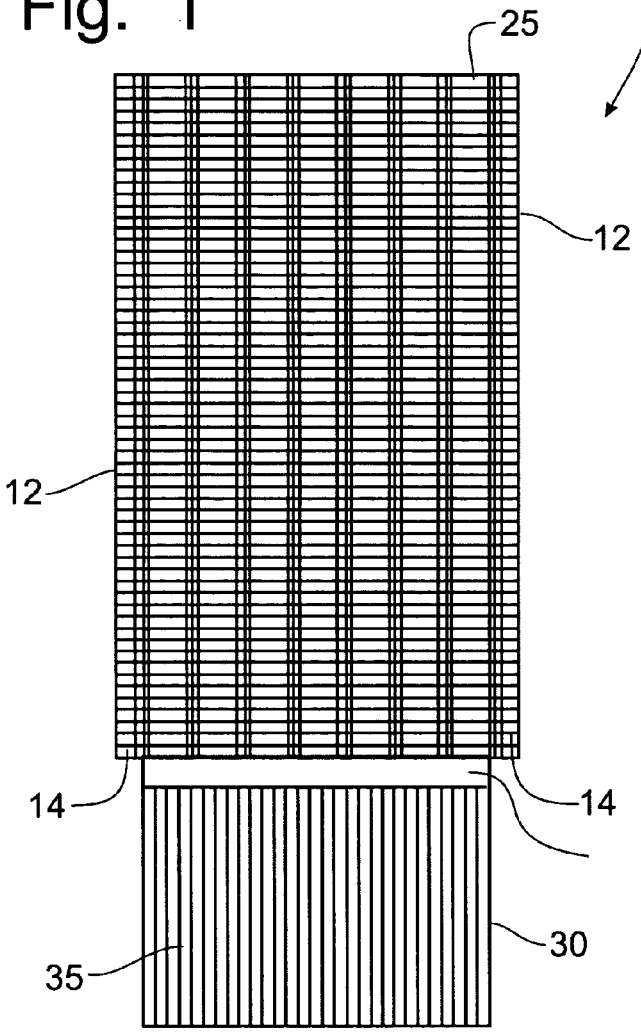
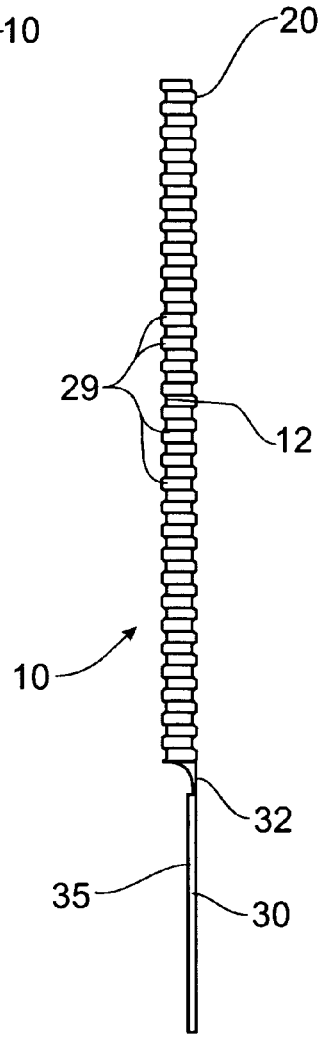
Fig. 3
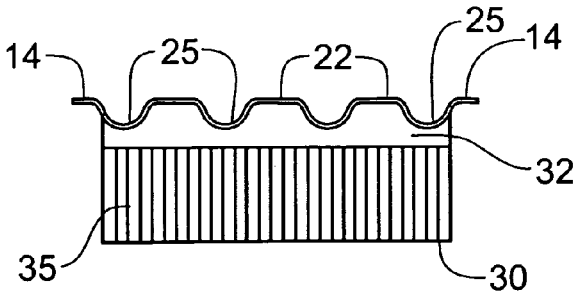
Fig. 2

Fig. 4
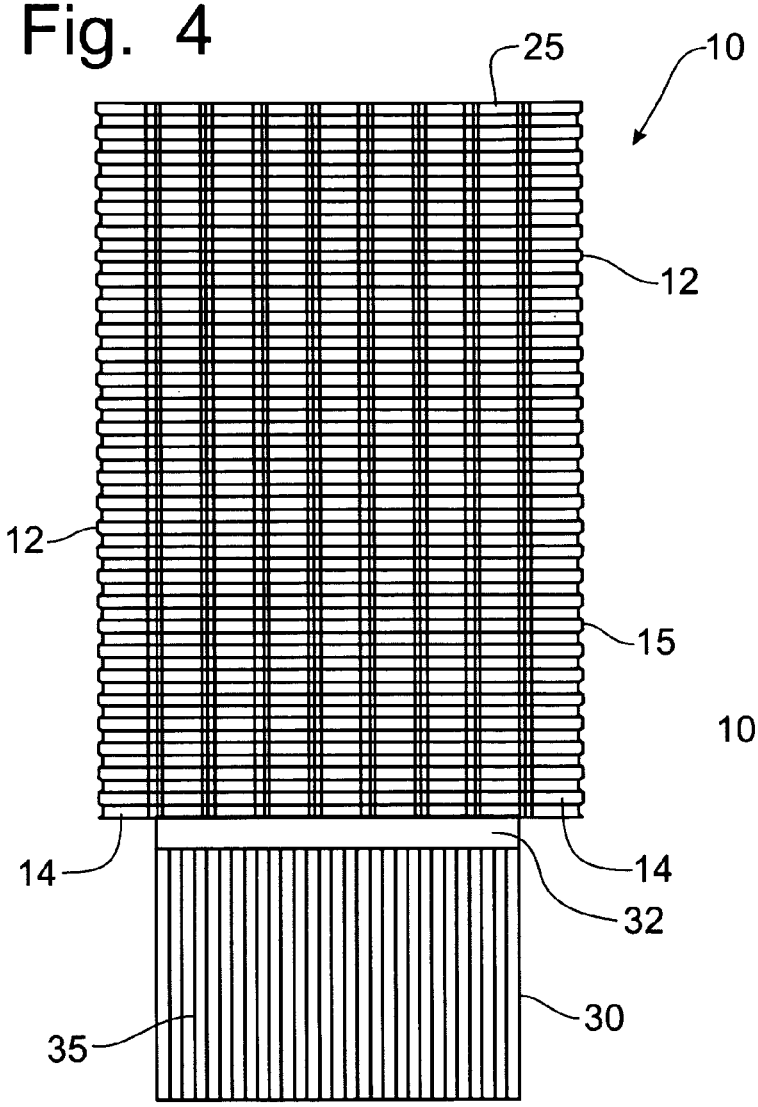
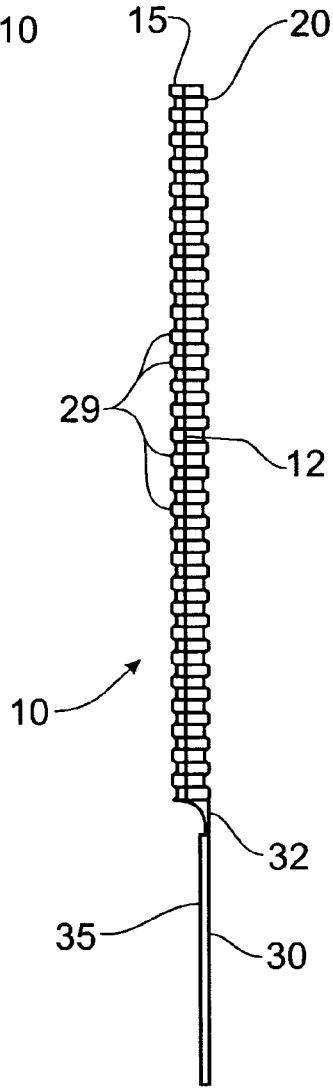
Fig. 6
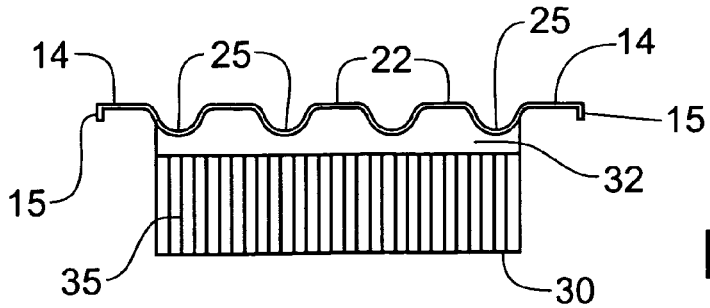
Fig. 5

Fig. 7
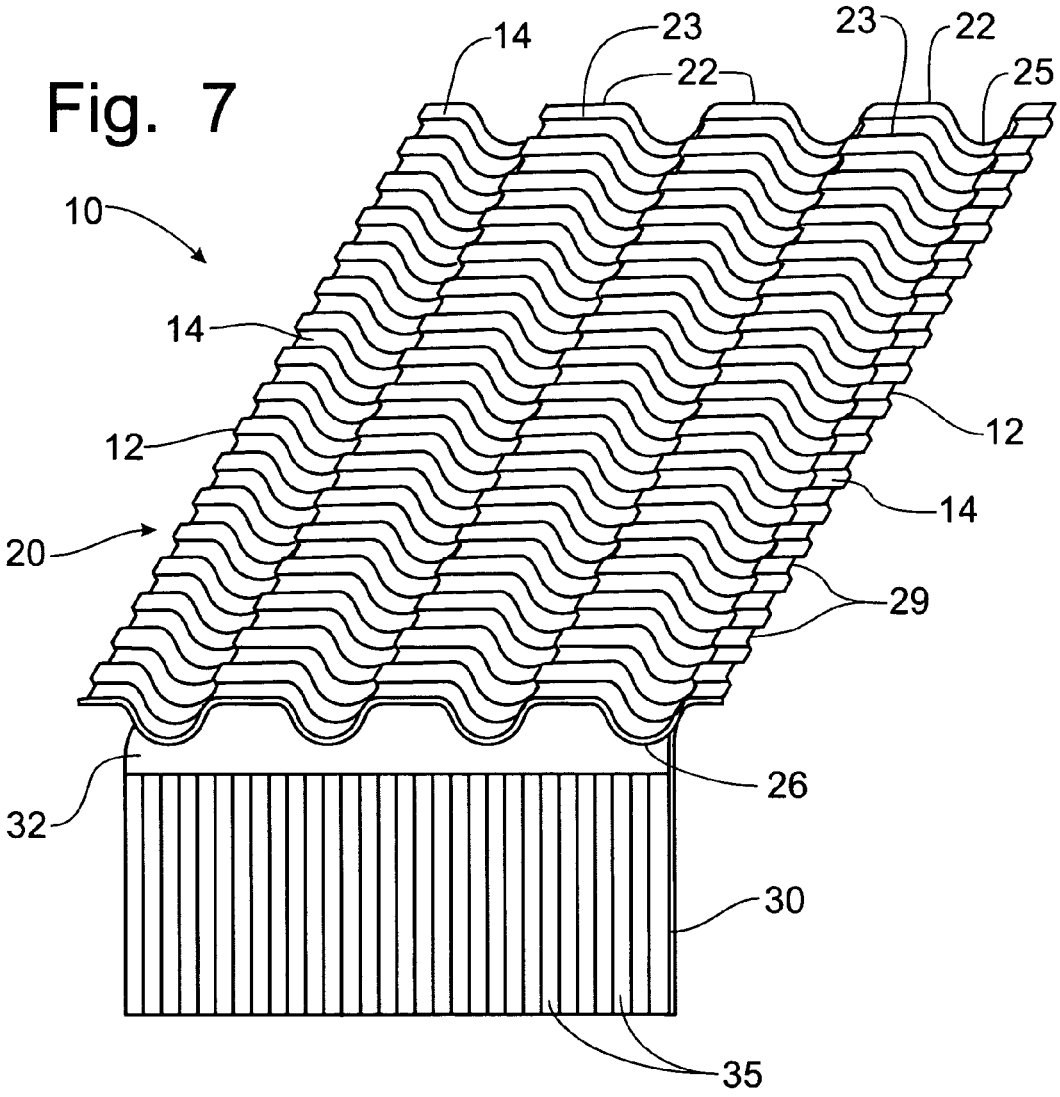
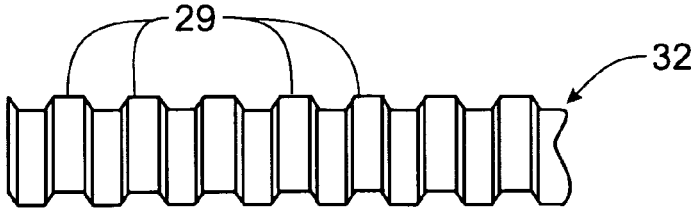
Fig. 8

Fig. 20
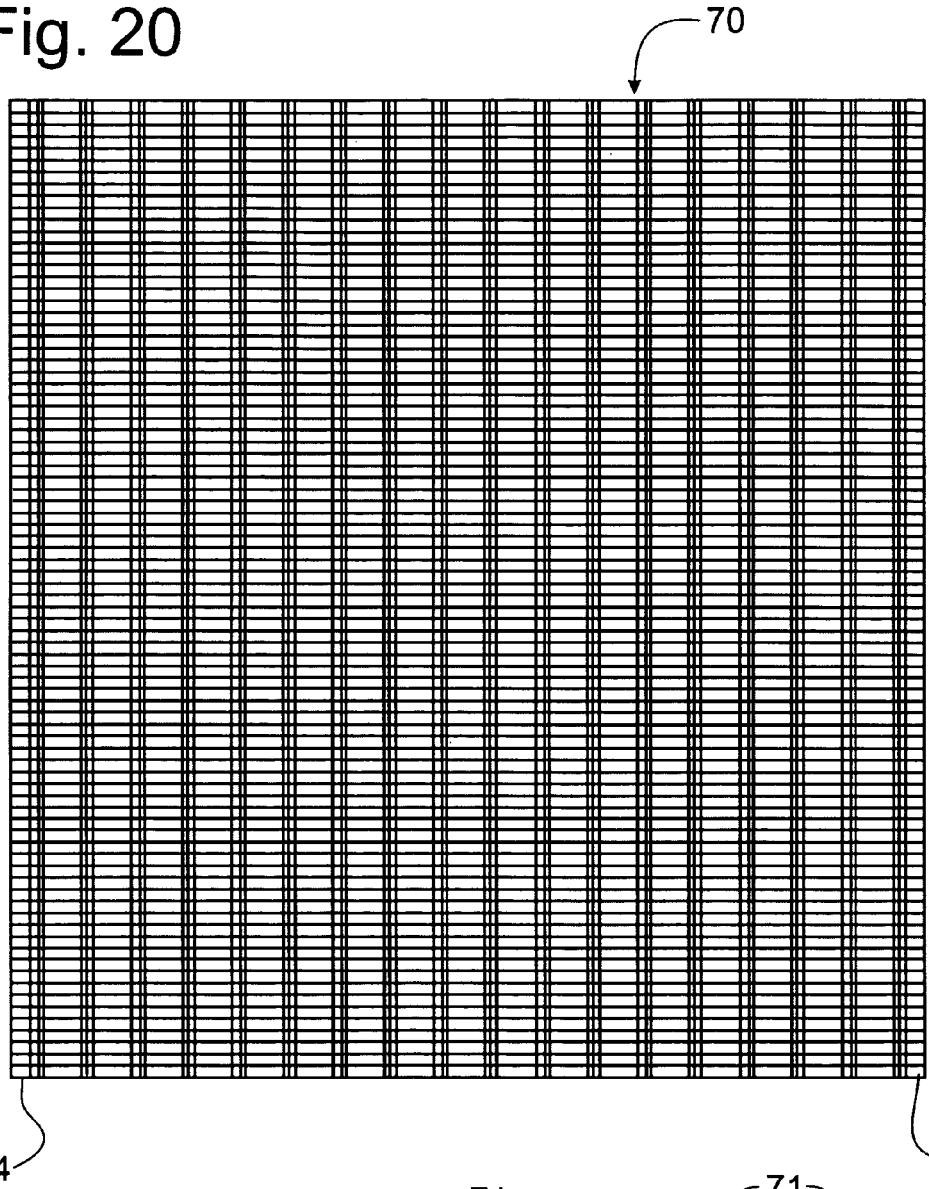
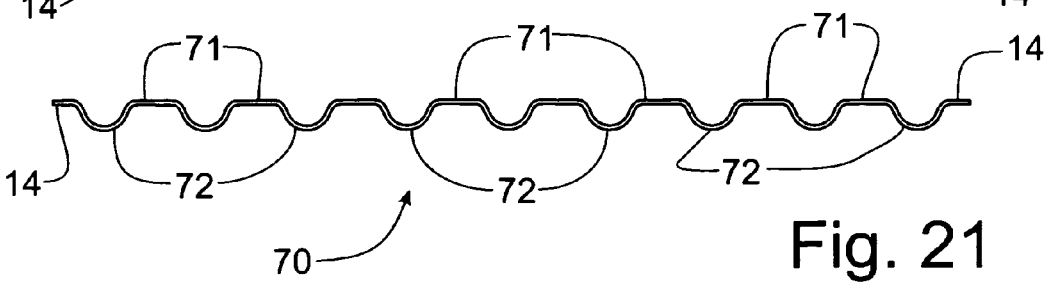
Fig. 21

BAFFLE VENT WITH INTEGRAL DRIFT BLOCKER

CROSS-REFERENCE TO RELATED APPLICATIONS

This application claims domestic priority on co-pending U.S. Provisional Patent Application Ser. No. 60/969,859, entitled "Baffle Vent with Integral Drift Blocker" and filed on Sep. 4, 2007, the contents of which are incorporated herein by reference.

FIELD OF THE INVENTION

This invention relates generally to attic vent baffles commonly used in residential building structures to allow ventilation flow from soffit vents into an attic space for venting from the attic, and, more particularly to a baffle vent with integral drift blocker that can be used in the manufactured housing industry.

BACKGROUND OF THE INVENTION

Attic ventilation systems are typically used in residential buildings to provide proper ventilation of the attic space, which is desired to help prevent formation of condensation along the interior surface of the roof. Condensation can damage the attic insulation and the wooden structure of the building itself. Proper ventilation also helps to prevent premature melting of snow accumulated on a building roof, which can lead to the formation of ice on the roof that presents a safety hazard and can also lead to roof damage. Such attic ventilation systems will utilize vents placed into the underside of the soffit, which projects outwardly from the roof of the building and forms the overhang at the perimeter of the building roof. The intent of these attic ventilation systems is for air to travel through the soffit vents into the attic space and be discharged through an attic vent, which is typically placed at the apex of the roof.

The use of insulation in the attic to provide a barrier to the transmission of heat between the occupied portion of the building structure and the unoccupied attic portion of the building can restrict, or even prevent, the flow of air from the soffits to the roof vent at the apex of the roof. The insulation can be packed along the joists of the roof trusses to the soffits and not allow a passageway for the movement of air past the insulation into the portion of the attic above the insulation. Known construction of the insulation material can include cellulose, rock wool, fiberglass and expanded foam, the latter being used most often in manufactured housing, i.e. housing constructed in a factory and transported to the job site instead of being constructed at the job site. To maintain a discrete passageway for the movement of from the soffit, past the insulation barrier, and into the upper portion of the attic for discharge through the roof vent, baffle vents have been provided for attachment to the interior side of the roof to keep the insulation separated from the interior surface of the roof deck.

One embodiment of a baffle vent can be seen in U.S. Pat. No. 7,094,145, granted on Aug. 22, 2006, to Palle Rye, et al, and assigned to Brentwood Industries, Inc. The Rye baffle vent is stapled to the interior surface of the roof sheeting between the roof rafters and includes a tail portion that is bent in the vicinity of the soffit to extend from the interior surface of the roof sheeting to engage the wall plate. This baffle vent thus forms a barrier that prevents the movement of insulation into the soffit area and restricting the flow of air into the insulation blanket and directs the air flow from the soffit over and above the insulation into the attic. The structure of the baffle vent incorporates a series of convolutions that are oriented parallel to the roof rafters to provide channels that define passageways for the movement of air past the insulation that is engaged against the baffle vent. In operation, the baffle vent utilizes the channels to keep the insulation away from the interior surface of the roof and establishes dedicated passages for the flow of air past the insulation along the interior surface of the roof sheeting.

Earlier configurations of baffle vents can be seen in U.S. Pat. No. 4,446,661, granted to Jan Jonsson, et al, on May 8, 1984, in which a corrugated sheet is fastened to the vertical surfaces of adjacent roof rafters to provide a plurality of longitudinally extending passageways for the movement of air past insulation in the roof. A major consideration in the design and manufacture of such baffle vents is the cost of such structures, particularly when taking into consideration the large square footage of the roofs of some residential buildings. Consequently, baffle vents have been fabricated extensively of foam or plastic material in narrow sheets that form self-supporting structures that can be handled and manipulated into position between the roof rafters for attachment against the interior surface of the roof sheeting. In U.S. Pat. No. 5,341,612, issued to Gary Robbins on Aug. 30, 1994, a baffle vent structure is formed of a thinner foam sheet material and includes a reinforced structure to prevent the vents from collapsing during shipping, handling and installation, as well as to prevent collapsing of the vents from compacted insulation which often is blown into attic areas of a building against the underside of the baffle vents.

Conventional residential construction affected at the job site will typically have the roof structure formed at the same time as the exterior shell of the building so as to get the building under roof to prevent the intrusion of foul weather into the interior of the building. The baffle vents described above are intended for use in such on-site construction techniques. Since the insulation is placed into the attic area long after the roof sheeting and shingles are added to the roof rafters, the baffle vents are formed to be placed between the roof rafters on the underside of the roof sheeting by attaching mounting flanged to either the vertical surfaces of the roof rafters, as is depicted in the aforementioned U.S. Pat. No. 4,446,661 to Jonsson, or the underside of the roof sheeting, as is depicted in U.S. Pat. No. 5,341,612 to Robbins. Generally, the baffle vents are installed as part of the installation of the insulation by contractors that specialize in the installation of insulation, rather than by the roofing contractor that will install the roof vent at the apex of the roof structure.

Manufactured housing is constructed in a factory setting where there is no pressing need to have the roof structure completed before the interior portions of the house are completed. As a result, the baffle vents can be installed on top of the roof rafters before the roof sheeting is fastened to the roof rafters. Generally, manufactured housing is formed with the interior drywall sheeting applied to the bottom side of the ceiling joists to form the inside ceiling of the housing before the roof is completed. The roof sheeting is then attached to the top surfaces of the roof rafters, followed by the application of the exterior roofing materials, typically fiberglass shingles. Insulation can then be installed between the joists on top of the drywall. While blanket fiberglass insulation or blown loose cellulose or fiberglass insulation can be used, expanded foam is often used in manufactured housing construction. The expansion rate of the foam places a substantial pressure on the baffle vent and will often collapse the passageways, resulting in the interruption of the air flow from the soffit past the insulation layer.

An example of a baffle vent that is adapted for use in the manufactured housing setting can be found in U.S. Pat. No. 5,596,847, granted to Michael Stephenson on Jan. 28, 1997. This baffle vent is formed with longitudinally extending ribs that are spaced on eight inch centers so that the single panel can be used on rafters whether spaced sixteen or twenty-four inches apart. A score line is formed on one of the interior ribs so that the excess eight inch strip can be removed if the baffle vent is used on rafters spaced at sixteen inched. In U.S. Pat. No. 4,096,790, issued on Jun. 27, 1978, to Laurence Curran, the baffle vent is formed to span across multiple roof rafters with a panel hanging down to engaged the wall plate and form a barrier to restrict the passage of insulation into the soffit area. In the Curran baffle vent configuration, mounting ribs are spaced at intervals corresponding to the roof rafter structure on which the baffle vent is to be applied. Thus, to be used with sixteen inch and twenty-four inch rafter spacings, the Curran baffle vent would have to be provided in two different models.

The Stephenson baffle vent configuration, and particularly in the Curran baffle vent configuration, the spacing of the longitudinally extending ribs provides a wide span between the ribs to define large passageways for the movement of air along the interior surface of the roof sheeting. Unfortunately, this wide expanse of unreinforced passageway, particularly when the baffle vent is manufactured from foam or a thin plastic material to maintain cost considerations, is subjected to collapse, especially when used with expanding foam insulation techniques. If the passageway collapses, the baffle vent is not functional to allow the passage of air from the soffit past the insulation layer to the upper portions of the attic structure.

Some configurations of manufactured housing are shipped over the highway with the roof structure, which is formed with at least two pivot devices on each side of the roof, collapsed to reduce the height of the transported structure. In such manufactured housing, the pitch of the roof structure is designed so that the attic portion of the building above the first floor can be utilized as an open storage area. Thus, the roof structure from the knee braces toward the center of the roof is open. The insulation is typically placed between the ceiling joists, trapped in the central portion of the building between the drywall panel forming the ceiling of the first floor and the floor decking placed on top of the ceiling joists at the central portion of the building. With the temperature differential between the roof area and the living space in the first floor of the building structure, condensation can accumulate beneath the attic flooring deck, which can eliminate the effectiveness of the insulation, leak into the ceiling of the first floor living space, and/or provide a medium for the growth of mold.

Accordingly, it would be desirable to provide a baffle vent structure that would be particularly adapted for use in the manufactured housing industry to establish and maintain passageways for the movement of air from the building soffit past the insulation layer into the upper attic area for discharge from the attic through a roof vent. It would also be desirable that the baffle vent be formed in a manner to resist a collapsing of the air flow passageways when expanded foam insulation material, or other similar insulation material that exerts a force onto the baffle vent, is installed against the baffle vent. Furthermore, it would be desirable to provide a vent structure that will assist in preventing the accumulation of condensation in the central portion of manufactured housing where the insulation is trapped between ceiling and floor panels on opposite sides of the ceiling joists.

SUMMARY OF THE INVENTION

It is an object of this invention to overcome the disadvantages of the prior art by providing a baffle vent structure that incorporates an integral drift blocker that can be oriented at an angle to the baffle vent structure.

It is another object of this invention to provide a baffle vent structure that is adapted for use in manufactured housing structures.

It is a feature of this invention that the baffle vent is designed to be placed on top of the roof rafters prior to the installation of the roof sheeting member.

It is another feature of this invention that the drift blocker portion of the baffle vent structure is integrally formed with the main body portion of the baffle vent structure by a planar portion that will allow the drift blocker portion to bend relative to the main body portion.

It is an advantage of this invention that the drift blocker portion will fall into a generally vertical orientation when the main body portion of the baffle vent structure is installed on the roof rafters.

It is still another feature of this invention that the main body portion is formed with transversely extending ribs to stiffen the main body portion, while the integral drift blocker portion is formed with longitudinally extending ribs to stiffen the drift blocker portion.

It is another advantage of this invention that the planar transition portion between the main body portion and the drift blocker portion is devoid of stiffening ribs to allow the drift blocker portion to move relative to the main body portion.

It is yet another feature of this invention to provide a baffle vent structure that incorporates a return lip along the longitudinally extending edges of the main body portion to position the main body portion on the top of the roof rafters in a manufactured housing operation before the roof sheeting is applied on top of the baffle vent structure.

It is still another object of this invention to provide a baffle vent structure that can be manufactured in sheet form to span across several roof rafters in a manufactured housing operation.

It is another feature of this invention that the sheet form of the baffle vent structure incorporates multiple drift blocker portions attached to the main body portion of the baffle vent structure.

It is still another advantage of this invention that the drift blocker portions are formed with a gap between the multiple drift blocker portions to accommodate the roof rafters extending between the drift blocker portions beneath the main body portion of the baffle vent structure.

It is yet another advantage of this invention that each of the drift blocker portions is attached to the main body portion of the baffle vent structure by respective planar transition portions.

It is a further advantage of this invention that the drift blocker portions can contain the insulation materials within the manufactured building structure while the manufactured housing is being shipped from the factory to the job site.

It is yet another object of this invention to provide a deck baffle panel on the ceiling joists to provide air movement beneath attic flooring to allow moisture to move toward a roof vent.

It is a further feature of this invention that the deck baffle panel extends past the knee brace interconnecting the ceiling joists and the roof rafters.

It is still a further advantage of this invention that the deck baffle panel will draw an air flow from the baffle vent to extract condensation from beneath the attic flooring.

It is yet another advantage of this invention that the use of the deck baffle panel will allow the removal of moisture that facilitates the growth of mold beneath the attic flooring.

It is yet a further feature of this invention that the deck baffle panel is formed in the same configuration as the main body portion of the baffle vent structure.

It is yet another object of this invention to provide a baffle vent for use in manufactured housing, which is durable in construction, inexpensive of manufacture, carefree of maintenance, facile in assemblage, and simple and effective in use.

These and other objects, features and advantages are accomplished according to the instant invention by providing a baffle vent incorporating an integral drift blocker portion that is connected to the main body portion of the baffle vent by a generally planar transition portion to allow the drift blocker portion to move relative to the main body portion. The main body portion is formed with transversely extending stiffening ribs, while the drift blocker portion is formed with longitudinally extending stiffening ribs with the transition portion being devoid of stiffening ribs to maintain flexibility in the transition portion. The baffle vent structure can be formed in large sheets that span several roof rafters with multiple integral drift blocker portions formed to be positioned between the roof rafters. A deck baffle panel is also provided in a configuration similar to the main body portion to be installed beneath attic flooring in manufactured housing to allow an air flow to remove moisture from beneath the attic flooring.

BRIEF DESCRIPTION OF THE DRAWINGS

The advantages of this invention will become apparent upon consideration of the following detailed disclosure of the invention, especially when taken in conjunction with the accompanying drawings wherein:

FIG. 1 is a top plan view of a baffle vent incorporating the principles of the instant invention, the depicted baffle vent being sized to fit between two adjacent roof rafters spaced on 16 inch centers, the integral drift blocker being oriented generally parallel to the convoluted body portion;

FIG. 2 is an end elevational view of the baffle vent depicted in FIG. 1 looking in the plane of the body portion, the drift blocker being oriented in the general configuration corresponding to deployment;

FIG. 3 is a side elevational view of the baffle vent depicted in FIG. 1;

FIG. 4 is a top plan view of an alternative embodiment of the baffle vent incorporating the principles of the instant invention, the integral drift blocker being oriented generally parallel to the convoluted body portion;

FIG. 5 is an end elevational view of the baffle vent depicted in FIG. 4 looking in the plane of the body portion, the drift blocker being oriented in the general configuration corresponding to deployment;

FIG. 6 is a side elevational view of the baffle vent depicted in FIG. 4;

FIG. 7 is a perspective view of the baffle vent structure shown in FIG. 1;

FIG. 8 is an enlarged partial side elevational view of the body portion of the baffle vent;

FIG. 20 is a top plan view of the deck baffle vent utilized in the manufactured building structure shown in FIGS. 17-19;

FIG. 21 is an end elevational view of the deck baffle vent shown in FIG. 20.

DETAILED DESCRIPTION OF THE PREFERRED EMBODIMENT

Figure 9:
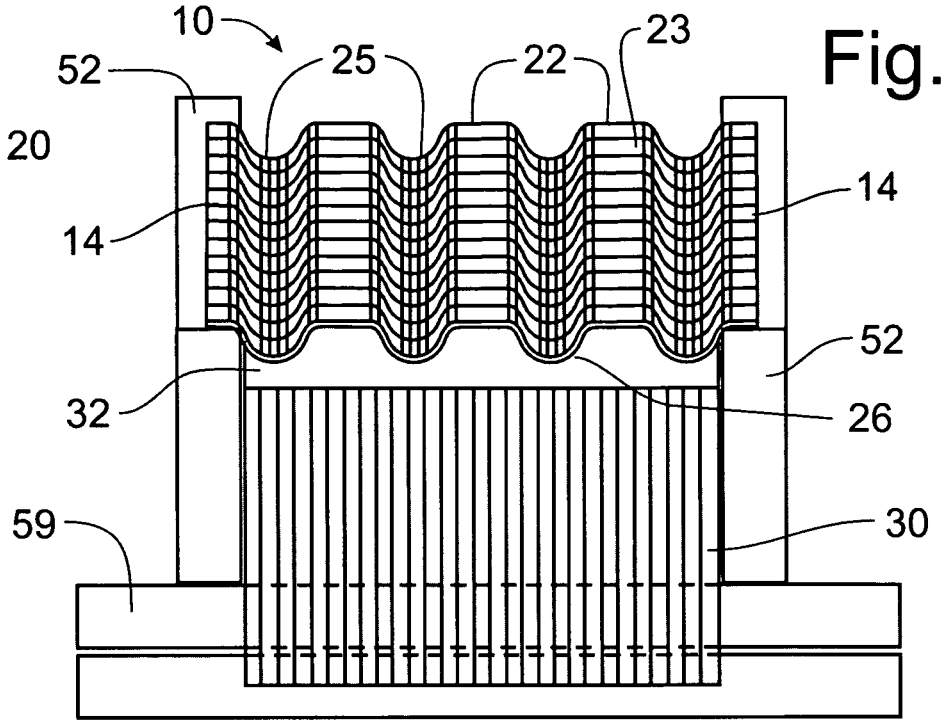
FIG. 9 is a vertical elevational view of the baffle vent depicted in FIG. 1 deployed between two adjacent roof rafters.
Figure 10:
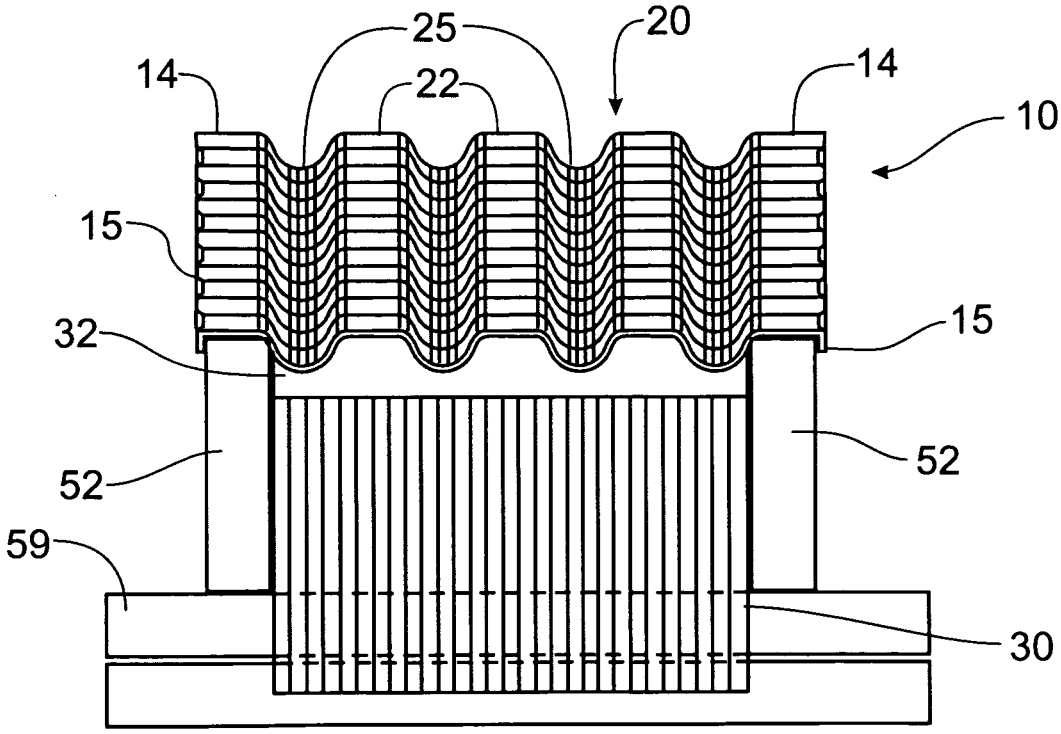
FIG. 10 is a vertical elevational view of the baffle vent depicted in FIG. 4 deployed between two adjacent roof rafters.

Referring to FIGS. 1-12, a baffle vent incorporating the principles of the instant invention can best be seen. The baffle vent 10 is preferably formed from polyvinyl chloride (PVC) film (not shown) having a thickness of about 12 to 16 millimeters through a conventional vacuum molding process in which the film is placed over a mold (not shown) and heated. A vacuum applied to the film draws the PVC film over a mold to cause the PVC film to assume the shape of the mold. The preferred embodiment of this baffle vent 10 would be formed in specific sizes that corresponding to conventional roof rafter spacing. The baffle vent 10 corresponding to 16 inch roof rafter spacing is depicted in FIGS. 1-12. The baffle vent 10 corresponding to a conventional 24 inch roof rafter spacing would preferably be formed with two more channels that would expand the overall width of the baffle vent 10.

The baffle vent 10 is formed with a convoluted body portion 20 having a series of parallel, longitudinally extending flat ridges or plateaus 22 preferably separated by a semicircular valley 25 defining an overall depth of the baffle vent 10. The ridges 22 are spaced at four inch centers to provide a uniform configuration that will correspond to both 16 and 24 inch rafter spacings. Each valley 25 between the longitudinally extending ridges 22 is preferably formed in a semicircular configuration to provide strength in cross-section to resist the expansive forces of the insulation materials, such as expanding foam insulation. Thus, each valley 25 has a rounded bottom surface 26 that is spaced vertically approximately one inch from the top surface 23 of the adjacent ridges 22.

Each valley 25 extends along the circular arc having a preferred radius of approximately seven-eighths of an inch from the center of the rounded bottom surface 26 through an angular deflection of approximately 68.5 degrees in each direction from the center of the bottom surface 22, measured from the tangent at the center of the rounded bottom surface 26, whereupon the valley 25 begins a reverse bend along a radius of approximately three-eighths of an inch to join with the horizontal, flat top surface 23 of the ridge 22 on either side of the valley 25.

The above-described pattern is repeated on four inch intervals measured from the center of the flat top surface 23 of one ridge 22 to the center of the flat top surface 23 of the next adjacent ridge 22, and consequently from the center of the rounded bottom surface 26 of each valley 25 to the center of the rounded bottom surface 26 of the next adjacent valley 25. With this particular configuration of ridges 22 and valleys 25, the baffle vent 10 can also mate with any oddly spaced roof rafter, so long as the spacing from the next adjacent roof rafter is a multiple of four inches. As an example, the end roof rafter on a roof structure is not always placed at the same sixteen or twenty-four inch spacing as the remaining roof rafters, because the overall length of the roof is not divisible by four feet. In such situations, the end rafter will typically have an end spacing of eight, twelve or twenty inches. The baffle vent 10 can easily accommodate such an odd end spacing with a ridge 22 that will mate with the top surface of the end roof rafter.

The configuration of the end elevation of the baffle vent 10, as is best seen in FIG. 2, is such that the arched valleys 25 are supported by the adjacent ridges 22 that are pressed against the underside of the roof sheeting and present an arch to resist the forces exerted by the insulation that is pushing the baffle vent 10 against the underside of the roof sheeting. The arched shape provides a strong geometric configuration that is resistant to collapse.

The body portion 20 of the baffle vent 10 is also preferably formed with transversely extending strengthening ribs 29 uniformly spaced longitudinally along the length of the body portion 20. The configuration of the ribs 29 are best seen in FIGS. 3 and 8. These strengthening ribs 29 substantially increase the ability of the body portion 20 to maintain its shape irrespective of the loading placed on the body portion. For example, where the body portion 20 extends along the roof rafters above the insulation layer and the insulation is not exerting any pressure on the body portion 20, the strengthening ribs 29 prevent the baffle vent 20 from sagging between the rafters. Furthermore, the strengthening ribs 29 increase the resistance of the valleys 25 to the pressure exerted by the insulation to keep the valleys from collapsing upwardly against the roof sheeting.

The embodiment of the baffle vent 10 shown in FIGS. 1-3 is formed to provide a side edge 12 along each transverse side of the baffle vent 10 that will be positioned approximately midway across the roof rafter when the roof rafters maintain the intended spacing. Accordingly, the next baffle vent 10 can be positioned with the side edge thereof adjacent the side edge 12 of the adjacent baffle vent 10 to provide all the baffle vents with an approximately ¾ inch mounting area 14 that can be stapled to the roof rafters on which the baffle vent 10 is mounted.

The embodiment of the baffle vent 10 shown in FIGS. 4-6 is formed with a wider mounting area 14 that is intended to cover the entire top surface of the roof rafter on which the baffle vent 10 is mounted. Furthermore, each side edge 12 is formed with a return lip 15 that will serve to "capture" the roof rafter. The adjacent baffle vent 10 will simply be positioned with the mounting area 14 positioned on top of the previously mounted baffle vent 10 with the return lip 15 extending into the adjacent valley 25. The advantage of forming the baffle vent 10 with a return lip 15 is that the baffle vent 10 can likely be mounted on top of the roof rafters without stapling the baffle vents 10 to the roof rafters. Once the roof sheeting is installed on top of the roof rafters and the baffle vents 10, the nails fixing the roof sheeting to the roof rafters will permanently secure the baffle vent 10 to the roof rafters. This feature of enabling the baffle vents 10 to be supported on the roof rafters without stapling until the roof sheeting is installed is particularly important in the production of manufactured housing, which is done indoors in a factory setting where wind in not typically a factor during the manufacturing process.

The baffle vent 10 is also formed with an integral drift blocker 30 that is positionable between the roof rafters on which the baffle vent 10 is mounted. The drift blocker 30 is formed from same PVC film that the body portion 20 is manufactured from, and is formed in the same vacuum molding process. The drift blocker 30 is a generally planar member that projects from the body portion 20 between the mounting areas 14. A transition portion 32 extends from the transversely convoluted body portion 20 to the planar configuration of the drift blocker 30. The transition portion 32 is preferably smooth, formed without any ribs 29, to allow the drift blocker 30 to bend about the transition portion 32. Without the strengthening ribs 29, the thin film transition portion 32 is quite flexible.

The drift blocker 30, however, is preferably formed with longitudinally (vertically) extending strengthening ribs 35 to provide resistance to the pressure exerted by the insulation. Transversely extending strengthening ribs, such as the ribs 29 in the body portion 20, would not be satisfactory as the transverse lines formed by such strengthening ribs would define a fold line, whereas the vertical strengthening ribs 35 in the drift blocker 30 would provide satisfactory results. Preferably, the vertical strengthening ribs 35 would extend along the entire transverse width of the drift blocker 20. Either embodiment of the body portion 10 would be formed with an integral drift blocker 30, as can be seen in FIGS. 1-10.

Figure 12:
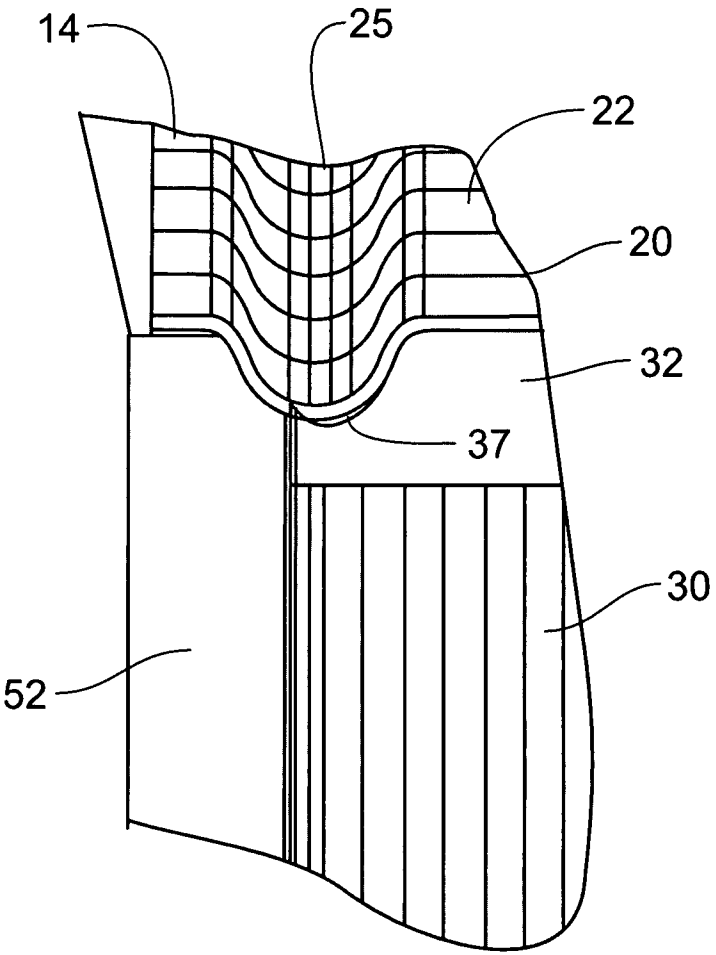
FIG. 12 is an enlarged partial vertical elevational view of the baffle vent shown in FIG. 11, but depicting the bending of the drift blocker to fit between narrowed rafter spacing.
Figure 11:
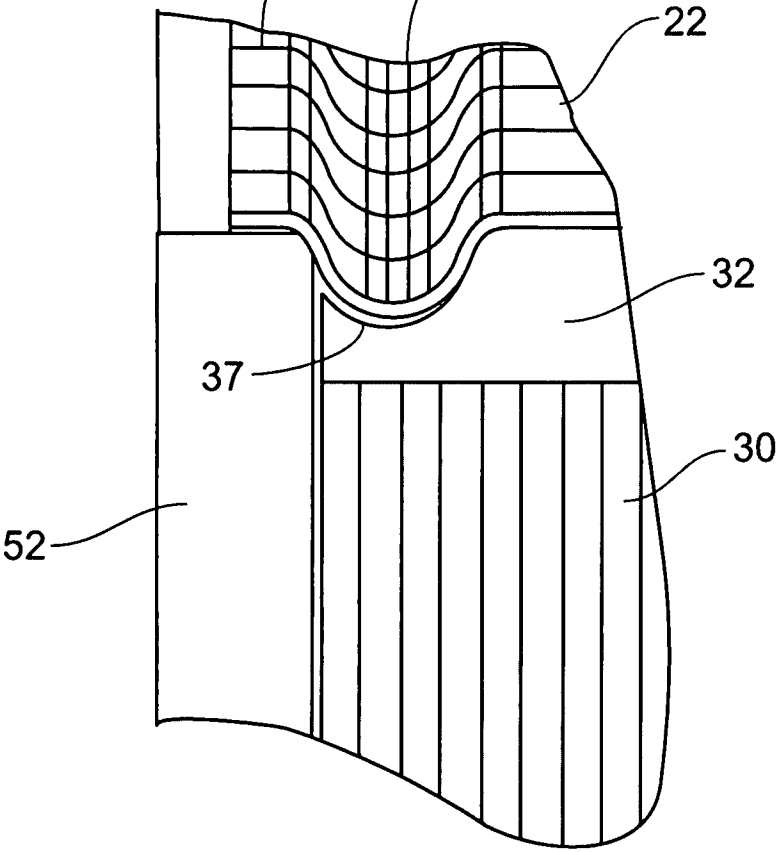
FIG. 11 is an enlarged partial vertical elevational view of the baffle vent depicted in FIG. 1 to show a feature that allows the drift blocker to be adjusted to accommodate rafter spacing less than the nominal intended spacing.

Referring now to FIGS. 11 and 12, the drift blocker 30 is preferably formed with a cut or separation line 37 at each transverse edge of the transition portion 32 where the transition portion 32 joins the convoluted body portion 20. This cut or separation line 37 is only intended to extend approximately 1½ to 2 inches from the edge of the drift blocker 30. This separation line 37 enables the drift blocker 30 to be folded along the transverse edge thereof when the spacing between the inside vertical faces of the roof rafters on which the baffle vent 10 is mounted is less than the nominal 14½ inches. A representative folding of the drift blocker 30 is depicted in FIG. 12.

Figure 13:
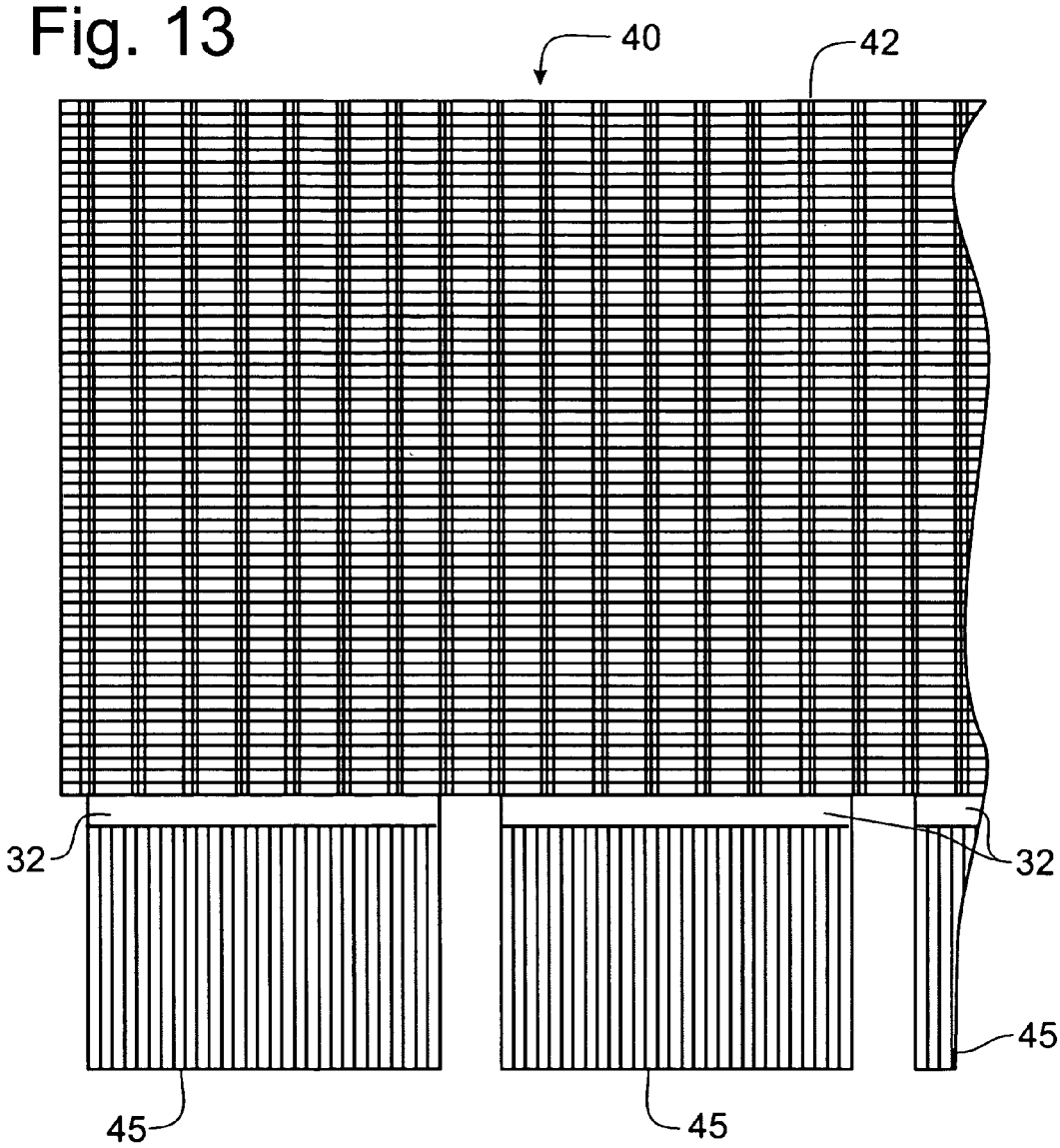
FIG. 13 is a partial top plan view of another alternative embodiment of the baffle vent incorporating the principles of the instant invention, with the baffle vent formed in a sheet that would span several roof rafter spacings, the integral drift blockers being oriented generally parallel to the convoluted body portion.
Figure 14:
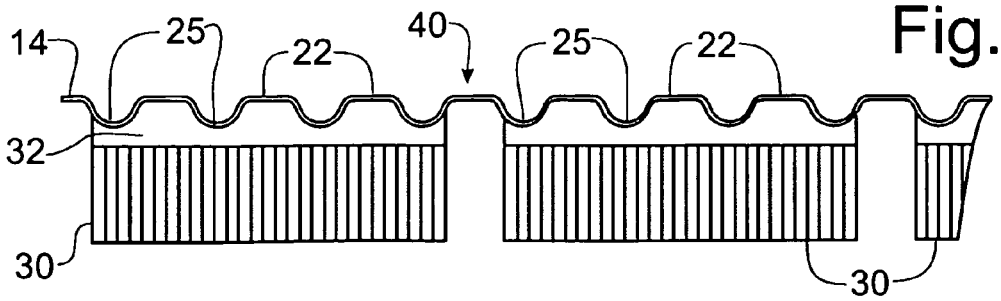
FIG. 14 is a partial end elevational view of the baffle vent depicted in FIG. 13 looking in the plane of the body portion, the drift blockers being oriented in the general configuration corresponding to deployment.

Yet another embodiment of the instant invention can be seen in FIGS. 13 and 14. Rather than form the individual baffle vent 10, as depicted in FIGS. 1-6, a sufficiently wide vacuum forming machine could form the baffle vent 40 in a continuous manner from a continuous roll of PVC film fed into the vacuum machine. Such a continuous baffle vent 40 would have a practical transverse width of about eight feet, which would correspond to four rafter spacings at 24 inches, or five rafter spacings at 16 inches. The practical considerations relate to handling abilities; however, an eight foot width would present an optimum maximum transverse width for use in the manufactured home industry. In this alternative embodiment, the drift blockers 45 project from the convoluted body portion 42 with a spacing therebetween corresponding to the roof rafters on which the continuous baffle vent 40 are to be mounted. With the spacing of the drift blockers 45 being a critical factor, an eight foot wide continuous baffle vent 40 for use with a 16 inch rafter spacing would have five drift blockers 45, while the 24 inch rafter spacing version would have only four drift blockers 45.

Figure 15:
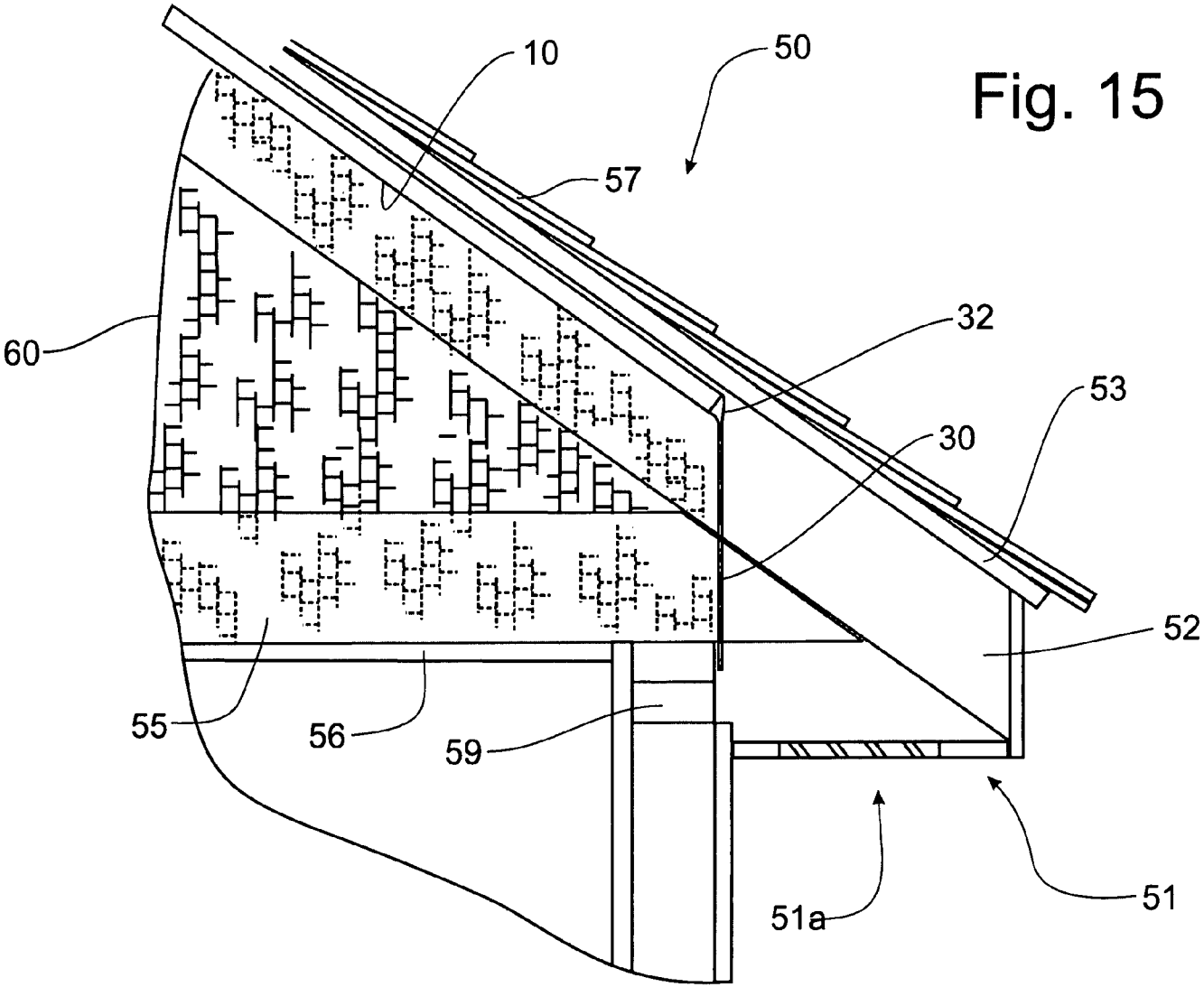
FIG. 15 is a partial cross-sectional view of a building structure taken through the soffit area and having a high roof pitch and with a baffle vent incorporating the principals of the instant invention installed therein.
Figure 16:
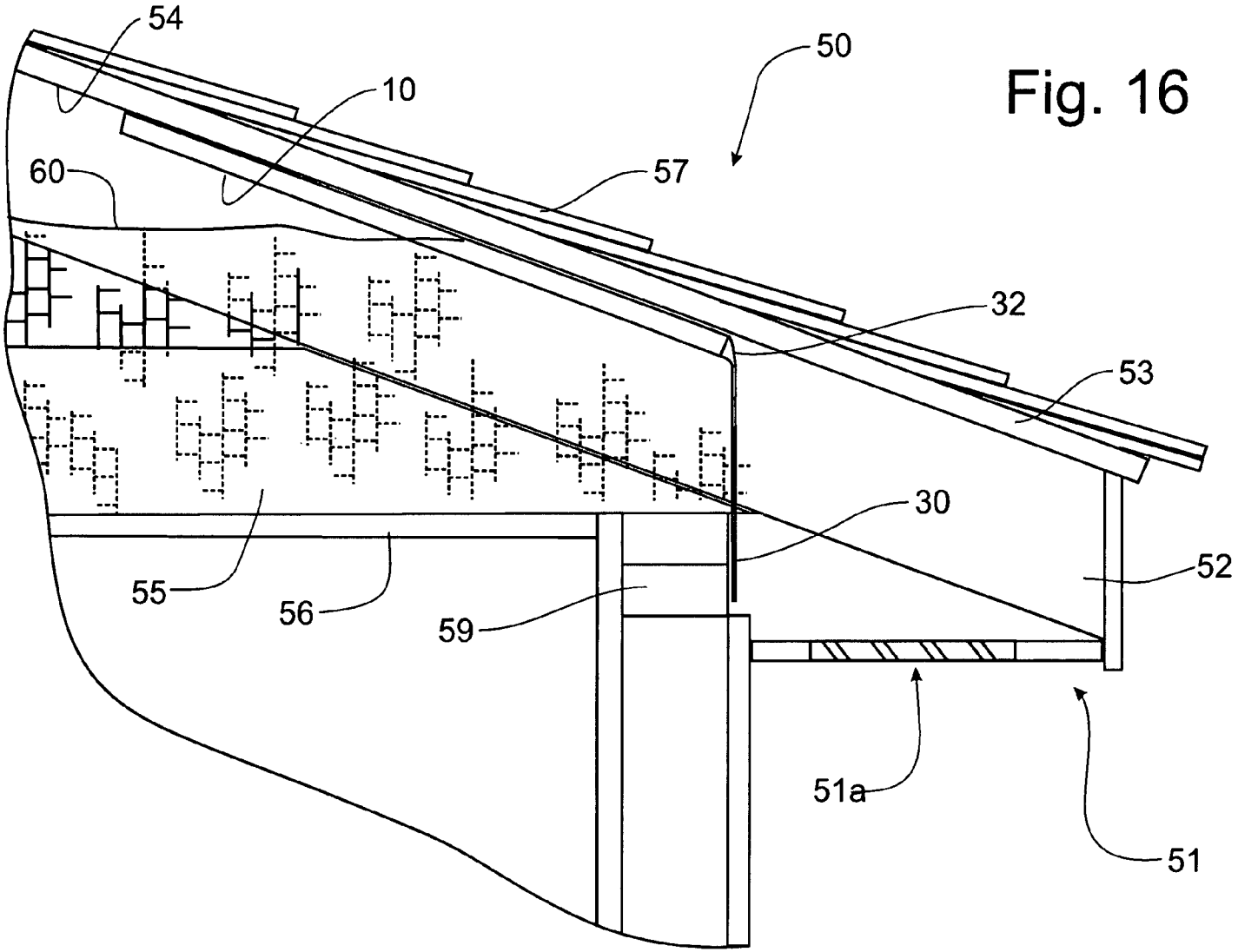
FIG. 16 is a partial cross-sectional view of a building structure taken through the soffit area and having a low roof pitch and with a baffle vent incorporating the principals of the instant invention installed therein.

As best seen in FIGS. 15 and 16, the typical roof structure 50 is formed with ceiling joists 55 that function as attic floor joists and are oriented horizontally to support a ceiling structure 56 attached to the underside of the joists 55. The roof rafters 52 are typically connected to the ends of the ceiling joists 55 and project upwardly therefrom at a prescribed angle to meet at an apex, forming with the ceiling joists 55 a conventional triangular configuration. The roof sheeting 53 is then fastened to the top surfaces of the roof rafters 52 to form the roof structure 50. The ceiling joists 55 and the roof rafters 52 may be supplied as a pre-assembled roof truss assembly having internal braces (not shown), or alternatively may be assembled at the construction site, and spaced at sixteen or twenty-four inch centers.

The roof rafters 52 will extend downwardly past the ceiling joists 35 to form the eaves or soffits 51, which are formed with vents 51*a* to allow air to flow into the soffits 51 from the outside. The roof rafters 52 and the ceiling joists 55 typically rest on the wall plate 59. After the roof sheeting 53 is attached to the roof rafters 52, the roofing surface, usually fiberglass shingles 57, is attached to the upper side of the roof sheeting 53 to complete the construction of the roof structure 50. One of ordinary skill in the art will recognize that a roof vent (not shown) is usually placed at the apex of the roof 50 to permit the movement of air from the attic.

Insulation 60 in the desired form is placed between and above the ceiling joists 55 to insulate the living area beneath the ceiling joists 55. The ceiling material 56 will retain the insulation in the attic. Preferably, the insulation 60 extends to the joinder of the roof rafters 52 and the ceiling joists 55 without extending into the soffits 51. The baffle vent 10 described above is positioned between the insulation 60 and the underside 54 of the roof sheeting 53, as will be described in greater detail below. Air can then flow from the outside through the vents 51*a* in the soffit 51 through the valleys 25 in the baffle vent 10 defining passageways through the insulation 60 barrier along the underside 54 of the roof sheeting 53 into the attic above the insulation 60. The air can then be discharged through the roof vent (not shown).

For the preferred use in manufactured housing, the baffle vent 10 is placed on top of the roof rafters 52 before the roof sheeting 53 is placed on the rafters 52. The baffle vent 10 need only extend along the roof sheeting 53 for a length that is greater than the height of the insulation 60 along the roof sheeting 53. For most insulation 60 configurations, a length of 39 inches is more than sufficient to extend into the attic above the insulation 60. The baffle vent 10 formed according to the principles of the instant invention does not require fastening to the tops of the roof rafters 32 when being installed, unless the configuration of the roof rafters mandates stapling to retain the baffle vent 10 in place until the roof sheeting 53 is applied. Once the baffle vent 10 has been mounted on top of the roof rafters 52, the roof sheeting 53 can then be installed on top of the baffle vent 10 and on top of the roof rafters 52 beyond the baffle vent 10. The fasteners used to attach the roof sheeting 53 to the roof rafters 52 will easily pass through the baffle vent 10 and retain the baffle vent 10 in the desired location.

As can be seen in a comparison of FIGS. 15 and 16, the baffle vent 10 can be used with a variety of roof structures irrespective of the pitch at which the roof is formed. For high pitched roofs, such as is depicted in FIG. 15, the vertical distance between the top of the roof rafter 52 and the wall plate 59 is greater than the corresponding vertical distance for a lower pitch roof structure 50. The longitudinal length of the drift blocker 30 will enable the bottom edge of the drift blocker 30 to be stapled to the wall plate 59 to secure the drift blocker 30 to the roof structure 50 and prevent the intrusion of insulation 60 into the soffit area 51. The same drift blocker 30 will extend further down the wall plate 59 in the lower pitch roof structures 50, as is represented in FIG. 16 to enable the drift blocker 30 to be stapled to the wall plate 59. Preferably, the drift blocker 30 will be stapled along the top edge of the wall plate 59, which provides some excess length of the drift blocker 30 when used on low pitch roofs 50; however, the excess length of the drift blocker 30 can be cut off with a knife if the excess length is not desired.

Figure 17:
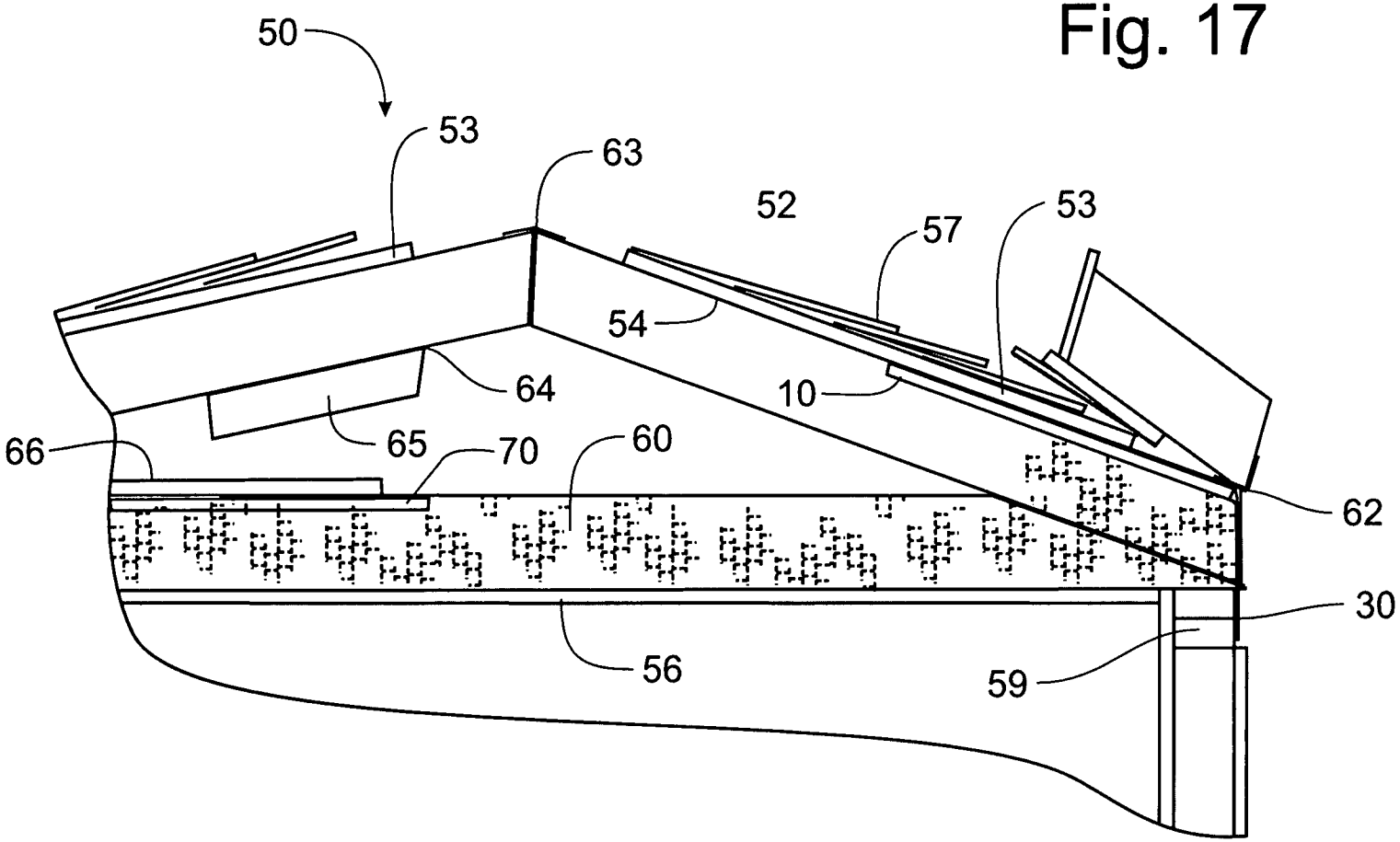
FIG. 17 is a partial cross-sectional view of a manufactured building structure taken through the soffit area and having a high roof pitch, the roof being pivotally collapsed for transport over the highway and having a baffle vent incorporating the principals of the instant invention installed therein, the ceiling joists also having a deck baffle vent positioned at the central portion of the building structure.

Some manufactured housing building structures are formed with sufficiently a high roof pitch that transport over the highway is problematic due to the height of the roof structure 50 above the ground and the transport width of the building structure. With such manufactured housing configurations, the roof structure 50 is formed with a first pivotal connection 62 in the roof rafters 52 to enable the soffit area 51 to be flipped onto the roof structure 50, as is depicted in FIG. 17. A second pivot connection 63 in the roof rafters enables the upper portion of the roof structure 50 to be lowered toward the ceiling joists 55. A third pivot connection 64 allows the knee brace 65 to be folded up against the roof rafters 52 for transport over the highway. In this configuration of manufactured housing, the baffle vent 10 can still be utilized, installed as described in detail above.

Figure 18:
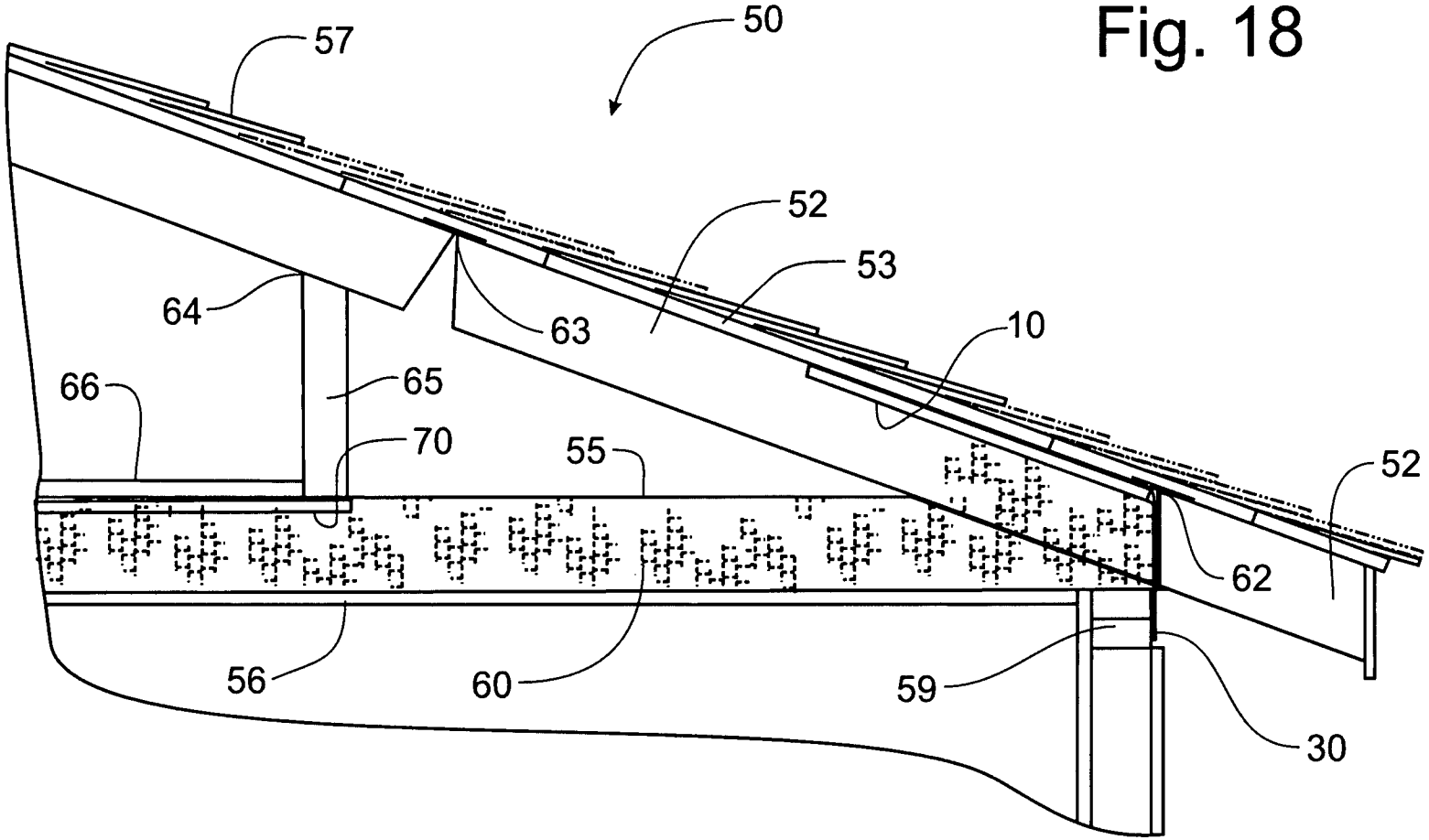
FIG. 18 is a partial cross-sectional view of the manufactured building structure shown in FIG. 17, but having the roof structure restored to the operative configuration.
Figure 19:
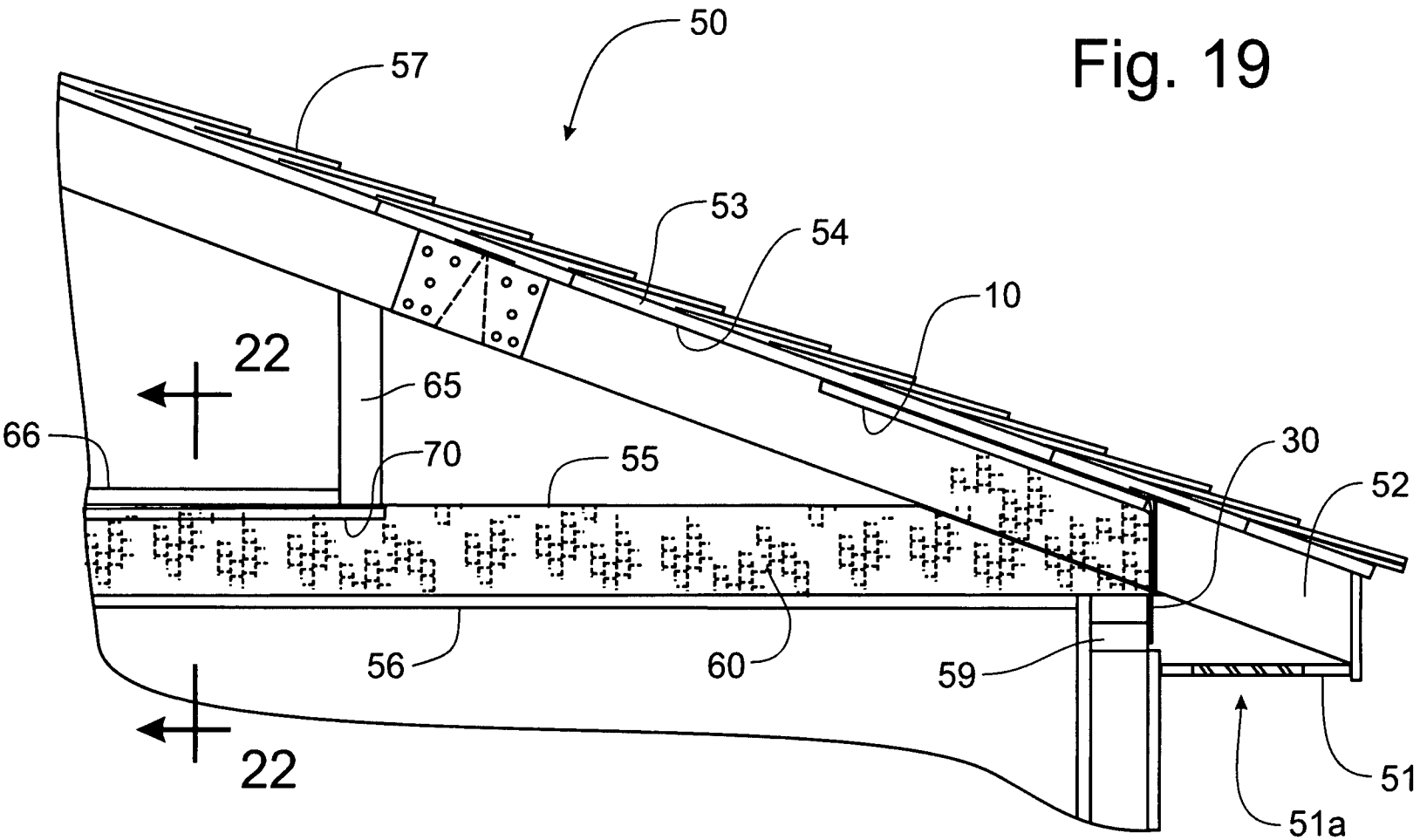
FIG. 19 is a partial cross-sectional view of the manufactured building structure shown in FIG. 18, but having the soffit and roof structure completed.
Figure 22:
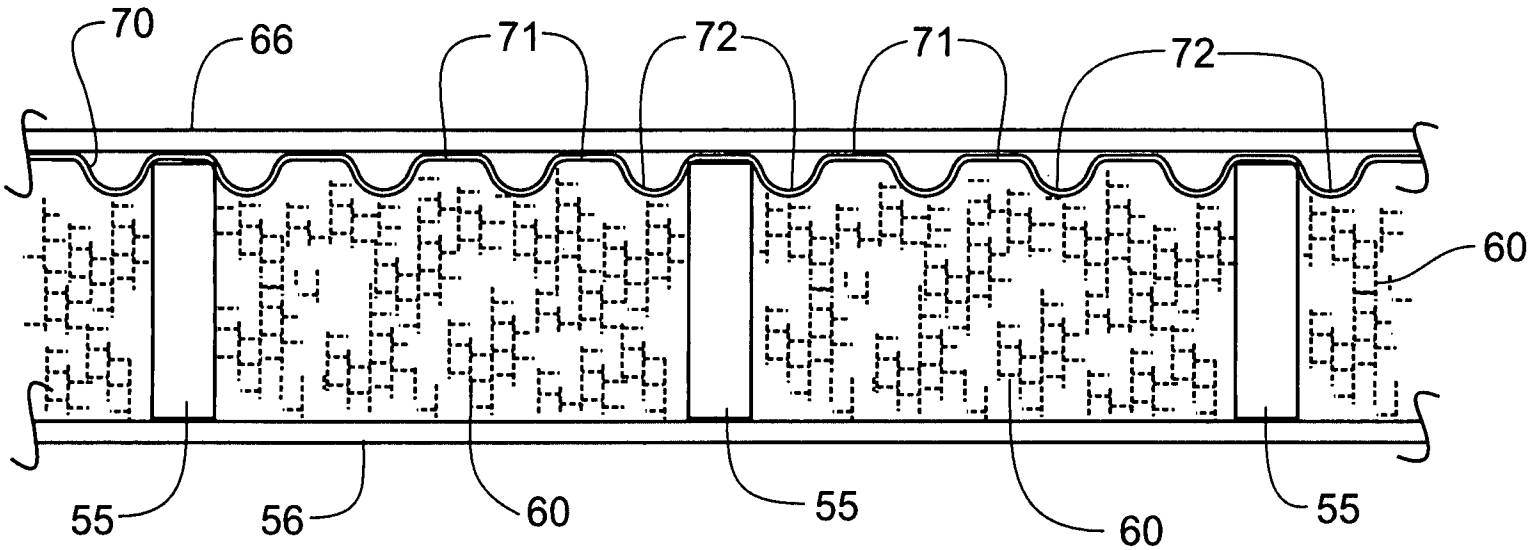
FIG. 22 is a cross-sectional view of the installed deck baffle vent corresponding to lines 22-22 in FIG. 19.

Restoration of the roof structure 50 is represented in FIGS. 18 and 19. In FIG. 18, the soffit 51 is lowered into place, the upper portion of the roof rafters 52 are raised to the proper orientation, and the knee braces 65 are positioned to support the rafters 52. Pieces of roof sheeting are placed over the pivot area and the pivot areas are then shingled to complete the roof structure 50. The soffit is completed with the soffit vent 51*a* in place.

As is depicted in FIGS. 17-19, but particularly in FIG. 19, the central portion of the attic area between the ceiling joists 55 and the roof rafters 52, and inwardly from the knee brace 65, is often configured in manufactured housing to be used as an attic storage area. To permit this use of the central portion of the attic area, the top surface of the ceiling joists 55 are capped with a floor 66 that traps the insulation 60 between the ceiling joists 55 and between the floor 66 and the ceiling panel (typically drywall) 56. The attic floor 66 extends only to the knee brace 65 as there is no need to continue the flooring 66 outwardly of the knee brace 65. The differential in temperature between the attic area above the floor 66 and the living area of the first floor below the ceiling panel 56, once the building structure has been erected and people are living therein, tends to create condensation which collects beneath the floor 66. Once sufficient condensation has been accumulated, the insulation 60 can become wet and moisture can leak through the drywall ceiling panel 56. Also, the moist environment between the floor 66 and the ceiling 56 is conducive to the growth of mold.

The placement of a deck baffle panel 70 over the ceiling joists 56 before the flooring material 66 is affixed to the ceiling joists 56 will provide a barrier for the passage of condensation from the flooring material 66 into the insulation 60. Furthermore, the deck baffle panel 70 will establish channels 72 for the passage of air beneath the flooring deck 66 to remove the moisture into the attic area outwardly of the knee brace 65. The flow of air from the baffle vent 10 on the roof rafters 52 to provide a passageway from the soffit 51 past the insulation 60 into the roof vent (not shown), will draw an air flow from the deck baffle vent 70 to extract the condensation from beneath the floor 66.

As can be seen in FIGS. 19-22, the deck baffle vent 70 is formed in the same convoluted configuration described above with respect to the body portion 20 of the baffle vent 10, with flat ridges 71 separated by semi-circular valleys 72. The deck baffle vent 70 is preferably formed in continuous sheets that are eight feet wide, although individual baffle vents, as depicted in FIGS. 1 and 4 could also be utilized. Preferably, the deck baffle vent 70 will terminate outwardly of the knee brace 65 to provide a passageway for the movement of air beneath the floor 66 into the attic area outwardly of the knee brace where this air can be mixed with the flow of air flowing from the soffit 51 to the roof vent (not shown) and expelled from the building structure.

While PVC film is the preferred material from which the baffle vent 10 is formed through the thermal molding, vacuum forming manufacturing process, one of ordinary skill in the art will recognize that other materials may be used in the manufacture of the baffle vent 10. Sheet metals, thermoplastics, and composite materials composed of fibers impregnated with thermoplastic materials can all be used to form the vent baffle 10. Sheet metals such as galvanized steel, stainless steel, aluminum and copper can be formed into vent baffles for use in the present invention. Thermoplastic materials which can be used in the present invention in addition to PVC film are, for example, polystyrenes, acetyls, nylons, acrylonitrile-butadiene-styrene (ABS), styrene-acrylonitrile (SAN), polyphenylene oxides, polycarbonates, polyether sulfones, polyaryl sulfones, polyethylene, polystyrene, terephthalates, polyetherketones, polypropylenes, polysilicones, polyphenylene sulfides, polyionomers, polyepoxides, polyvinylidene halides, and derivatives and/or mixtures thereof. The particular material used may depend upon the desired end use and the application conditions associated with that use, as is well known in the art.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A baffle vent for maintaining a passageway between roof rafters of a building for a flow of air from a soffit to a roof vent past insulation material installed between said roof rafters which are covered by roof sheeting, comprising:

a main body portion having a first end and a longitudinally spaced second end defining a longitudinal length of said main body portion, said main body portion further having first and second transversely spaced sides defining a width dimension of said main body portion, said main body portion being formed with a plurality of longitudinal ridges and valleys extending between and terminating at said first and second ends, said valleys providing a flow path for said flow of air past said insulation material, said ridges providing longitudinal stiffness in said main body portion to maintain said flow path;

a drift blocker portion having, third and fourth ends spaced longitudinally from said first and second ends of said main body portion and further having opposing transversely spaced side edges defining a width dimension of said drift blocker portion wherein the width dimension of said drift blocker is smaller than said first width dimension of said baffle vent panel and wherein said drift blocker being formed of a shape devoid of ridges and valleys to permit movement of said drift blocker relative to said baffle vent; and a flexible transition portion interconnecting said second end of said main body portion and said third end of said drift blocker portion to permit movement of said drift blocker portion relative to said main body portion, said transition portion being connected to each of said ridge and valley at said second end of said main body portion when the drift blocker portion is positioned angularly with respect to the main body portion and having a longitudinal length sufficient to join to each of said ridges and valleys corresponding to said width dimension of said drift blocker to provide an impermeable barrier between said drift blocker and said main body portion along said width dimension of said drift blocker while allowing said drift blocker to be moved relative to said main body portion without requiring modification to said baffle vent.

2. The baffle vent of claim 1 wherein said main body portion and said drift blocker are formed with stiffening ribs, said flexible transition portion between said body portion and said drift blocker being devoid of stiffening ribs.

3. The baffle vent of claim 2 wherein said stiffening ribs on said main body portion are oriented transversely, while said stiffening ribs on said drift blocker are oriented longitudinally.

4. The baffle vent of claim 3 wherein said drift blocker is generally planar.

5. The baffle vent of claim 4 wherein said width dimension of said main body portion is sufficient to span multiple roof rafters, said drift blocker being formed as separately formed drift blocker members connected to said main body portion by respective transition members.

6. The baffle vent of claim 5 wherein each said drift blocker member has said width dimension sized to fit between adjacent said roof rafters.

7. The baffle vent of claim 6 wherein said drift blocker members are formed with a transversely extending gap therebetween to accommodate the positioning of a corresponding said roof rafter.

8. The baffle vent of claim 4 wherein each said side of said main body portion is sized to cover a top surface of said roof rafter, each said side of said main body portion being formed with a return lip to extend along a side of said roof rafter.

9. The baffle vent of claim 4 wherein said width dimension of said drift blocker is smaller than said width dimension of said main body portion.

10. The baffle vent of claim 9 wherein said drift blocker is formed with a separation line between said main body portion and said transition portion to permit said transition portion to be separated from said main body portion and facilitate a bending of said drift blocker along the corresponding said side edge thereof to accommodate fitting between narrowed roof rafter spacing.

11. A roof for manufactured housing comprising:

a plurality of transversely spaced roof rafters covered by roof sheeting;

a baffle vent panel located between said roof rafters and said roof sheeting, said panel having first and second longitudinally spaced ends defining a length dimension of said panel and first and second transversely spaced sides defining a first width dimension of said panel, said panel being formed with a plurality of longitudinal ridges and valleys extending between and terminating at said first and second ends to provide a flow path for the movement of air between said panel and said roof sheeting, said ridges providing longitudinal stiffness in said baffle vent panel;

at least one drift blocker integrally connected to said panel by a flexible transition portion that permits said drift blocker to move relative to said panel about said transition portion, said drift blocker having a second width dimension smaller than said first width dimension of said baffle vent panel and being oriented generally vertically between said roof rafters for engagement with a wall member of said manufactured housing, said transition portion being joined to each of said ridges and valleys corresponding to said second width dimension and being formed with a shape devoid of ridges and valleys to permit movement of said drift blocker relative to said baffle vent panel without modification of said baffle vent panel, said transition portion having a longitudinal length sufficient to form a barrier along a transverse width dimension of said drift blocker that is joined to each respective ridge and valley along said second width dimension of said drift blocker.

12. The roof of claim 11 wherein said baffle vent panel spans at least three roof rafters, one of said drift blockers being positioned between each adjacent roof rafters covered by said baffle vent panel, said drift blockers being formed with a gap therebetween to accommodate the positioning of a corresponding said roof rafter.

13. The roof of claim 12 wherein each said drift blocker is formed with a separation line between said panel and said transition portion to permit said transition portion to be separated from said panel and facilitate a bending of said drift blocker along the corresponding said side edge thereof to accommodate fitting between narrowed roof rafter spacing.

14. The roof of claim 12 wherein each said side of said panel is sized to cover a top surface of said roof rafter, each said side of said panel being formed with a return lip to extend along a side of said roof rafter.

15. The roof of claim 11 wherein said panel and said drift blocker are formed with stiffening ribs, said flexible transition portion between said panel and said drift blocker being devoid of stiffening ribs, said stiffening ribs on said panel being oriented transversely, while said stiffening ribs on said drift blocker are oriented longitudinally.

16. The roof of claim 15 wherein drift blocker is generally planar.

* * * * *